United States Patent [19]

Rijckaert et al.

[11] Patent Number: 4,634,920

[45] Date of Patent: Jan. 6, 1987

[54] ELECTRICAL LAMP HAVING A SLEEVE MOUNTED IN A LAMP CAP OF SYNTHETIC MATERIAL

[75] Inventors: Josephus F. Rijckaert; Rudolf Sanders, both of Eindhoven, Netherlands

[73] Assignee: U.S. Philips Corporation, New York, N.Y.

[21] Appl. No.: 685,709

[22] Filed: Dec. 24, 1984

[30] Foreign Application Priority Data

Jan. 9, 1984 [NL] Netherlands ..... 8400064

[51] Int. Cl.[4] ..... H01J 5/48; H01J 5/50

[52] U.S. Cl. ..... 313/318; 313/113; 362/255; 362/267

[58] Field of Search ..... 313/318, 113; 362/255, 362/267

[56] References Cited

U.S. PATENT DOCUMENTS

| | | | |
|---|---|---|---|
| 4,100,448 | 7/1978 | Chipner et al. | 313/318 |
| 4,119,877 | 10/1978 | Grewe et al. | 313/318 |
| 4,122,367 | 10/1978 | Esklavon et al. | 313/318 |
| 4,412,273 | 10/1983 | Helbig et al. | 313/113 |
| 4,473,770 | 9/1984 | Baba et al. | 313/318 |
| 4,492,893 | 1/1985 | Steiner et al. | 313/318 |
| 4,507,712 | 3/1985 | Dolan et al. | 362/267 |
| 4,513,356 | 4/1985 | Mikola | 362/267 |

*Primary Examiner*—Saxfield Chatmon

*Attorney, Agent, or Firm*—David R. Treacy

[57] ABSTRACT

A lamp, such as a replaceable halogen unit for an automotive head lamp, has a transparent vessel pinch seal gripped in a clamping plate which has a circular cylindrical flange. The lamp cap is cup-shaped, and made of synthetic material having electrical contacts passing through the bottom of the cap. The lap vessel is connected to the cap by a metal cup-shaped sleeve, whose bottom is mechanically secured to the lamp cap, preferably by a rivet which also secures a contact in place.

4 Claims, 1 Drawing Figure

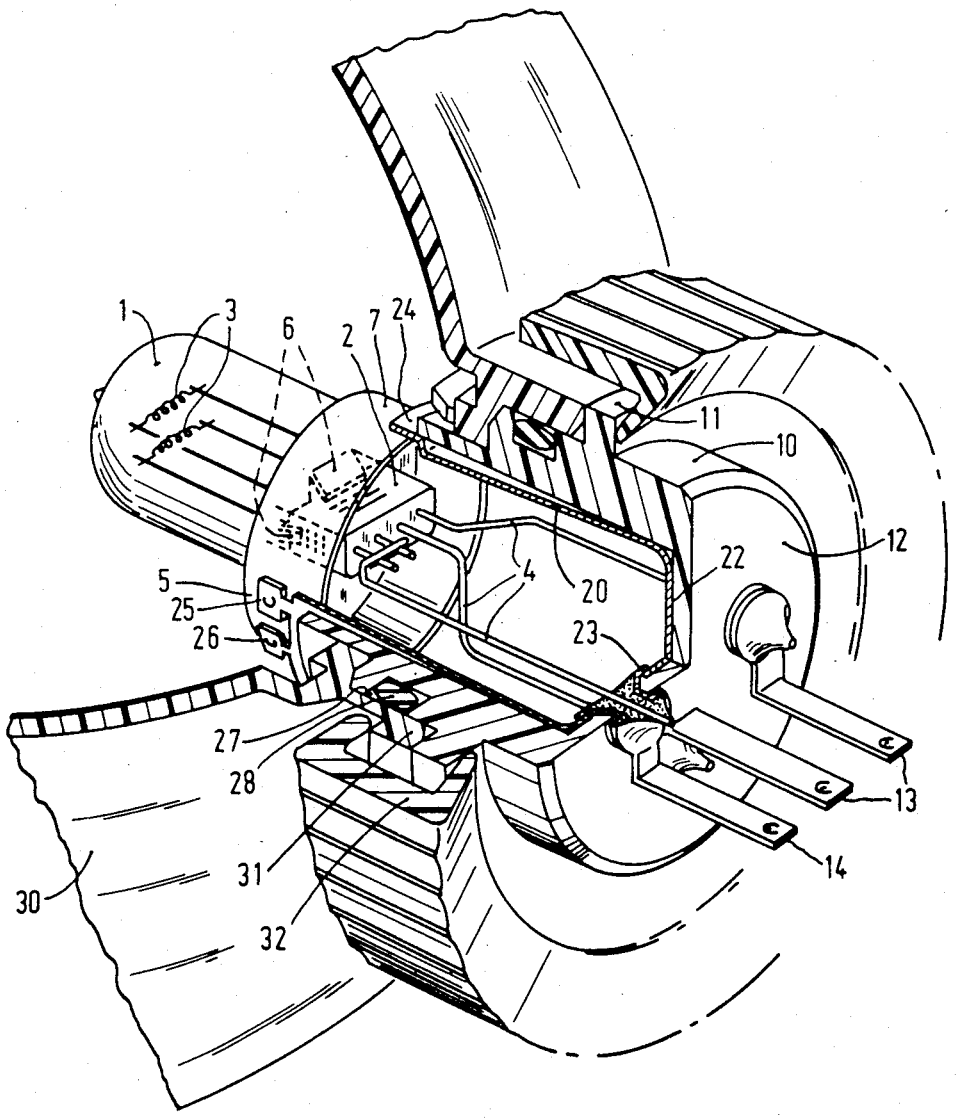
1
3
6
2
7
24
11
10
12
22
20
4
5
25
26
23
27
28
13
14
31
30
32

ELECTRICAL LAMP HAVING A SLEEVE MOUNTED IN A LAMP CAP OF SYNTHETIC MATERIAL

The invention relates to an electrical lamp having a transparent sealed lamp vessel having a pinch seal; current conductors passing through the wall of the lamp vessel; a metal clamping plate having an opening through which the pinch seal extends and in which the pinch seal is held fast by lugs formed on the clamping plate, the clamping plate having a substantially circular-cylindrical flange; a cup-shaped lamp cap of synthetic material provided with a projecting collar and with contacts which are secured to and which project below the bottom of the cap, to each of which contacts a respective current conductor is connected; and a substantially circular-cylindrical metal sleeve secured to and projecting beyond the cap and telescopically secured to the cylindrical flange of the clamping plate, Such a lamp is known from U.S. Pat. No. 4,412,273, and is made for use as a headlamp of motor vehicles, its lamp cap being located in an opening of a reflector. The projecting collar at the lamp cap then serves as an abutment stop against the reflector for defining the correct position of the lamp cap with respect to the reflector. The lamp vessel is connected to the lamp cap in a manner such that the electrical element is in a predetermined position with respect to the collar of the lamp cap.

With respect to lamps of the kind mentioned for use in reflectors as a car headlamp, a requirement is imposed as to the strength with which the lamp vessel is mounted in the lamp holder: when a rod with a head of hard rubber having a minimum radius of 1 mm is used to exert a force of 17.8±4N at right angles to the axis of the lamp vessel and at the level of and at right angles to the axis of a filament arranged therein, the displacement of the lamp vessel must not be more than 0.13 mm.

The lamp described in this U.S. Patent does not meet this requirement when its sleeve is not rigidly secured to its lamp cap. It is precisely this connection of the sleeve to the lamp cap, which is left open by this Patent.

A lamp having a clamping plate is also known from U.S. Pat. No. 4,119,877, but this lamp has a totally different cap arrangement.

SUMMARY OF THE INVENTION

The invention has for its object to provide a lamp which is suitable for use as a headlamp in a reflector, in which the lamp vessel is rigidly mounted in the lamp cap without the use of cement or glue, and without the current conductors playing a mechanical role in the mounting.

According to the invention, this object is achieved in a lamp of the kind described above in that the metal sleeve has a bottom and is mechanically secured at its bottom to the bottom of the lamp cap. This may be effected, for example, by means of a tongue at the bottom of the metal sleeve which is passed through the bottom of the lamp cap and is deformed below it, for example by bending or twisting the tongue.

In a preferred embodiment, the metal sleeve is secured to the bottom of the lamp by one or more hollow rivets. In a variation thereof, the metal sleeve is secured together with one of the contacts projecting below the bottom of the lamp cap by means of a hollow rivet, such as a flanged tube.

Rigidity can be enhanced if the metal sleeve has projections distributed over its periphery, which bear on the lamp cap near its edge. These projections may be bulges of the metal sleeve, but may alternatively be stamped out tongues.

In a very favorable embodiment, wherein the metal sleeve surrounds the clamping plate, tongues are provided at the free end of the metal sleeve, distributed over its periphery and have an inwardly directed depression on which a welded joint is formed.

In one embodiment, incisions may be provided in the circular-cylindrical flange of the clamping plate. Such incisions facilitate the step of flanging the edge of the clamping plate.

The light source of the lamp according to the invention can be a pair of electrodes in an ionizable gas or one or more filaments in a gas that may contain halogen.

BRIEF DESCRIPTION OF THE DRAWING

An embodiment of the lamp according to the invention is shown in the drawing in perspective view, partly cut away, mounted in a reflector also cut away.

DESCRIPTION OF THE PREFERRED EMBODIMENT

In a quartz glass lamp vessel 1 sealed in a vacuum-tight manner and having a pinch seal 2 there are arranged two filaments 3 in a hydrobromide-containing inert gas. Current conductors 4 extend through the wall of the lamp vessel and the pinch seal 2 to the filaments 3.

The pinch seal 2 extends through an opening in a metal clamping plate 5, which has lugs 6 which hold the pinch seal fast. The clamping plate 5 has a cylindrical sleeve-like flange 7 which is remote from the filaments 3.

A cup-shaped lamp cap 10 of synthetic material has a projecting collar 11, 13, 14 which are secured to its bottom and project below it, and a cylindrical wall 15 at the cap open end away from the contacts 13, 14. A respective current conductor 4 is connected to these contacts.

The lamp cap 10 accommodates a metal sleeve 20 having a bottom 22, which sleeve projects beyond the lamp cap 10 and is mechanically secured at its bottom 22 to the bottom 12 of the lamp cap by means of a rivet 23. The rivet 23 grips around the contact 14, the bottom 12 of the lamp cap 10 and the flat bottom 22 of the metal sleeve 20. The bottom 22 is provided with wide openings not shown in the drawing, through which the current conductors 4 extend to the contacts 13 without touching bottom 22, so as to be electrically insulated from each other and from the contact 14.

The metal sleeve 20 has a number of projections in the form of stamped tongues, which are distributed over the periphery of the sleeve 20 and one of which 24 is shown. These tongues bear on the lamp cap 10 near the open end of the cylindrical wall portion 15.

The metal sleeve 20 surrounds the clamping plate 5 and has at its free end tongues 25,26 on which welding connections with the clamping plate 5 are formed. The tongues are located as three pairs distributed over the periphery of the sleeve 20 at an axial location adjacent and just beyond the projections 24. They have inwardly directed depressions on which the welded connections are realized.

After the lamp vessel has been mounted in the clamping plate 5, the clamping plate 5 is inserted into the sleeve 20, the current conductors extending to the outside through the bottom 12 of the lamp cap 10. The filaments 3 are then positioned with respect to the collar 11 and cams (not shown) disposed at this collar by displacing, rotating, and, if desired, tilting the clamping plate 5 in the sleeve 20. Subsequently, welded connections are formed on tongues 25, 26.

The outer sheath of the lamp cap 10 is provided with a groove 27 which accommodates a rubber sealing ring 28.

A reflector 30 has a collar 31 around an opening into which the lamp cap 10 is passed.

A union 32 holds the collars 11 and 31 pressed against each other, holds the reflector 30 in a closed position by means of the sealing ring 28, and holds the filaments 3 in position.

The lamp according to the invention can be manufactured very rapidly and its lamp vessel is secured in a very stable manner in the lamp cap, as the pinch seal is held fast by the clamping base plate, the plate is welded to the metal sleeve and the sleeve is rigidly connected to the lamp cap.

What is claimed is:

1. An electrical lamp comprising a transparent lamp vessel sealed in a vacuum-tight manner, and having a pinch seal, an electrical element arranged within the lamp vessel, current conductors extending through the wall of the lamp vessel to the electrical element, a metal clamping plate having lugs; an opening though which the pinch seal extends and in which the pinch seal is held fast by said lugs; and a substantially circular-cylindrical flange, a cup-shaped lamp cap of synthetic material having a projecting collar and a bottom, and contacts secured to and projecting below said bottom, to each of which contacts a respective current conductor is connected, and a substantially circular-cylindrical metal sleeve secured to and projecting beyond said cap, telescopically secured to the circular-cylindrical flange of said plate, characterized in that said metal sleeve is shaped as a cup having a substantially flat bottom, and is mechanically secured to said cap by fixing said cup bottom to the bottom of the lamp cap.

2. A lamp as claimed in claim 1, characterized in that the cup bottom, together with one of the contacts, is fixed by a rivet.

3. An electrical lamp comprising a transparent lamp vessel sealed in a vacuum-tight manner, and having a pinch seal, an electrical element arranged within the lamp vessel, current conductors extending through the wall of the lamp vessel to the electrical element, a metal clamping plate having lugs; an opening though which the pinch seal extends and in which the pinch seal is held fast by said lugs; and a substantially circular-cylindrical flange, a cup-shaped lamp cap of synthetic material having a projecting collar and a bottom, and contacts secured to projecting below said bottom, to each of which contacts a respective current conductor is connected, and a substantially circular-cylindrical metal sleeve secured to and projecting beyond said cap, telescopically secured to the circular-cylindrical flange of said plate, characterized in that said cap is cup-shaped and has a circular-cylindrical wall at an open cap end remote from said contacts, said metal sleeve is shaped as a cup having a substantially flat bottom, as is mechanically secured to said cap by fixing said cup bottom to the bottom of the lamp cap, and said metal sleeve further comprises projections axially adjacent the locations where the sleeve is telescopically secured to the circular-cylindrical flange, distributed over the sleeve periphery, arranged to bear against said wall adjacent said open cap end.

4. A lamp as claimed in claim 3, characterized in that the cup bottom, together with one of the contacts, is fixed by a rivet.

* * * * *